US010138008B2

(12) United States Patent
Zacche' et al.

(10) Patent No.: US 10,138,008 B2
(45) Date of Patent: Nov. 27, 2018

(54) FILLING DEVICE FOR HETEROGENEOUS PRODUCTS

(71) Applicant: WEIGHTPACK S.R.L., Goito (IT)

(72) Inventors: Vanni Zacche', Goito (IT); Gianguido Corniani, Goito (IT)

(73) Assignee: Weithtpack S.r.L. (IT)

( * ) Notice: Subject to any disclaimer, the term of this patent is extended or adjusted under 35 U.S.C. 154(b) by 23 days.

(21) Appl. No.: 15/340,759

(22) Filed: Nov. 1, 2016

(65) Prior Publication Data

US 2017/0129629 A1 May 11, 2017

(30) Foreign Application Priority Data

Nov. 5, 2015 (IT) ..... 102015000069398

(51) Int. Cl.
*B65B 3/28* (2006.01)
*B67C 3/28* (2006.01)
(Continued)

(52) U.S. Cl.
CPC ..... *B65B 3/28* (2013.01); *B65B 3/08* (2013.01); *B65B 39/004* (2013.01); *B67C 3/202* (2013.01); *B67C 3/2608* (2013.01); *B67C 3/28* (2013.01)

(58) Field of Classification Search
CPC ..... B65B 3/28; B65B 3/08; B65B 39/004; B67C 3/28; B67C 3/2608; B67C 3/202
(Continued)

(56) References Cited

U.S. PATENT DOCUMENTS 2,524,560 A * 10/1950 Cote ..... B65B 1/28 141/12
3,192,940 A * 7/1965 Wiersholm ..... B64D 39/06 137/220
(Continued)

FOREIGN PATENT DOCUMENTS

DE 1268872 5/1968
WO 2005003017 A1 1/2005
(Continued)

OTHER PUBLICATIONS

Italian Search Report dated Jun. 8, 2016 in corresponding Italian No. ITUB20154875.
(Continued)

*Primary Examiner* — Jason K Niesz
*Assistant Examiner* — James Hakomaki
(74) *Attorney, Agent, or Firm* — Waller Lansden Dortch & Davis, LLP; Matthew C. Cox

(57) ABSTRACT

The present invention relates to a filling device for heterogeneous products or products which have solid or semi-solid suspended elements with variable dimensions and compactness. The valve of the invention can be used in net weight filling machines.
In particular, the invention relates to a filling device (1) for filling machines, comprising a hollow body (2) in which a shutter member (3) is movably fitted and acts in cooperation with a dispensing member (4), which is coaxial to said shutter member (3), to close or open a dispensing opening (5) for a product (P) to be dispensed into a container (C), characterized in that said dispensing member (4) comprises a rotatable shaft (10) comprising a screw portion (14) adapted to impart a dispensing pressure and a mixing to the product (P).

13 Claims, 3 Drawing Sheets

(51) Int. Cl.

| | |
|---|---|
| ***B67C 3/26*** | (2006.01) |
| ***B65B 3/08*** | (2006.01) |
| ***B65B 39/00*** | (2006.01) |
| ***B67C 3/20*** | (2006.01) |

(58) Field of Classification Search
USPC ..... 141/83; 137/220
See application file for complete search history.

(56) References Cited

U.S. PATENT DOCUMENTS 3,517,688 A * 6/1970 Scholle ..... B65B 39/004 137/240
3,533,434 A * 10/1970 Smith ..... F16K 1/126 137/220
3,949,792 A 4/1976 Ramoneda Sibidi
4,185,669 A * 1/1980 Jevakohoff ..... B65B 39/04 141/263
4,270,585 A * 6/1981 Mette ..... B67C 3/12 141/37
4,597,694 A * 7/1986 Legille ..... G01F 11/24 222/317
5,098,677 A * 3/1992 Sauer ..... C01F 15/00 252/187.24
5,988,234 A * 11/1999 Wegman ..... B65B 1/12 141/286
2007/0102048 A1* 5/2007 Bravo ..... F16K 1/126 137/495
2012/0001370 A1* 1/2012 Zacche' ..... B29C 49/783 264/523

FOREIGN PATENT DOCUMENTS

WO 2007138397 A2 12/2007
WO 2013167223 A1 11/2013

OTHER PUBLICATIONS

Italian Written Opinion dated Nov. 11, 2015 in corresponding Italian No. ITUB20154875.

* cited by examiner

FILLING DEVICE FOR HETEROGENEOUS PRODUCTS

FIELD OF THE INVENTION

The present invention relates to a filling device for heterogeneous products or products which have solid or semi-solid suspended elements with variable dimensions and compactness. The valve of the invention can be used in net weight filling machines.

BACKGROUND ART

The use of weight filling systems with highly heterogeneous products or products which have solid or semi-solid suspended elements with variable dimensions and compactness is rather problematic.

The known weight filling methods are all characterized by filling valves connected to a tank or a collector, and the dynamics of opening/closing the valve depend on the strategy for measuring the weight of the product dispensed. The spillage of the product from the valves is promoted by the pressure caused by the geodetic head of the product itself or by a slight pressurization (a few meters of water column at maximum) of the tank or collector which supplies the product to the valves.

In addition to requiring constant mixing to avoid the stratification of the solid parts due to the difference in density, the heterogeneous products have the problem that certain pieces tend to aggregate close to the outlet of the valves, thus compromising the correct filling strategy.

In order to ensure continuity to such an operation, a pressurization scheme needs to be applied to the product, which is incompatible with weight measurement systems but is typical of volumetric filling systems. This type of method is based on volumetric piston systems. These systems are physically incapable of ensuring actual filling constancy because as the physical variables of the product change, such as for example the temperature or the distribution of the suspended pieces at different densities, the dispensing at constant volume changes the weight quantity filled in the container and the resulting quantity of product actually packaged.

Considering that legislation considers the weight of the packaged product as the reference declaration on the label, volumetric systems require over-filling the container in order to avoid sanctions should underweight products be introduced in the market. Thereby, more product is given to the user than what is purchased, with resulting increases in production costs.

SUMMARY OF THE INVENTION

The problem addressed by the present invention is therefore that of providing a filling device which solves the inherent problems of the prior art devices, while allowing an accurate and efficient filling even in the case of products with high heterogeneity, i.e. comprising pieces of product having different size and consistency.

Such a problem is solved by a filling device as outlined in the appended claims, the definitions of which form an integral part of the present description.

Further features and advantages of the present invention will become more apparent from the description of certain embodiments thereof, given hereinbelow only by way of non-limiting, indicative example, with reference to the accompanying drawings

DETAILED DESCRIPTION OF THE INVENTION

Figure 1:
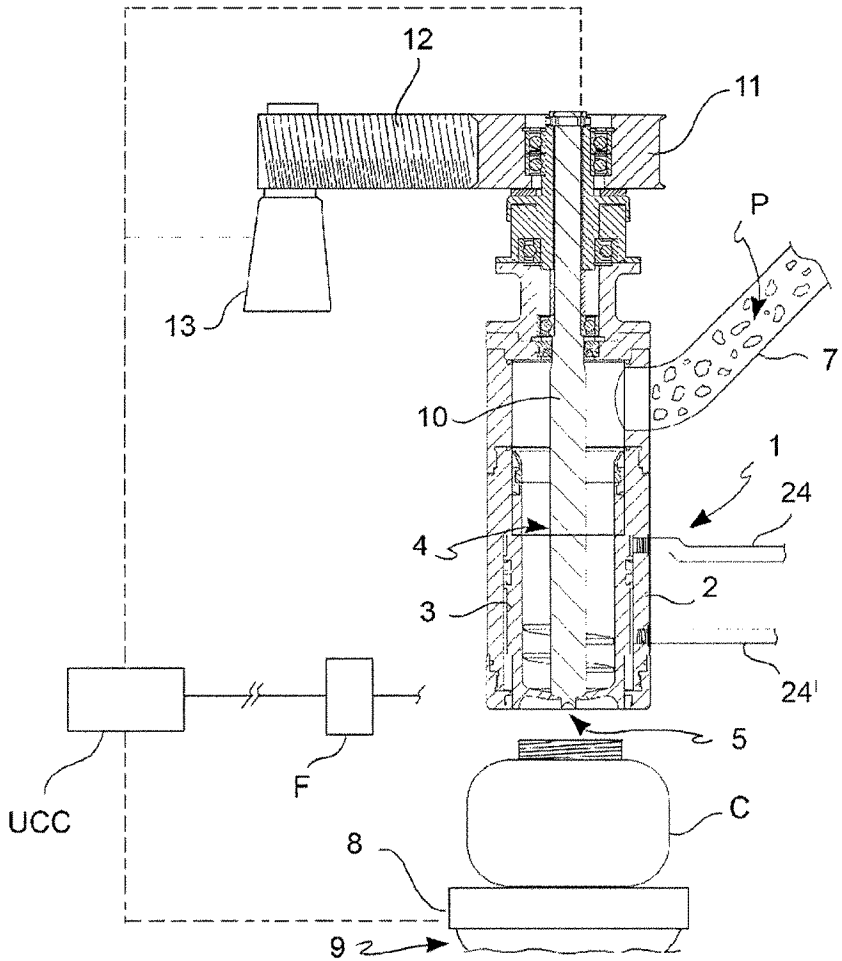
FIG. 1 diagrammatically depicts a detail of a filling machine for heterogeneous products, which comprises a valve according to the invention.

With reference to the figures, the filling device of the invention, indicated by numeral 1, comprises a hollow body 2 in which a shutter member 3 is movably fitted and acts in cooperation with a dispensing member 4, which is coaxial to said shutter member 3, to close or open a dispensing opening 5 for the product P to be dispensed into a container C.

The filling device 1 is inserted into a linear or rotary filling machine (not shown), in which a plurality of filling devices are operable in sequence. All filling devices 1 are operatively connected to a single motor, such as for example a synchronous motor or an asynchronous motor, by means of suitable motion transmission systems, or any filling device 1 may be operated by a dedicated motor thereof, for example a stepper motor or a brushless motor.

Container C is supported by a plate 8 operatively arranged on a loading cell 9 for weighing the empty and full container C.

The hollow body 2 comprises an upper portion 2*a* having a wall thickness greater than the lower portion 2*b*, so as to form a shoulder 17 facing downwards at the junction point between said upper portion 2*a* and said lower portion 2*b*. An inlet opening 6 for product P to be dispensed is located in the upper portion 2*a* of the hollow body 2. The inlet opening 6 is connected to a conduit 7 which in turn is connected to a collector or tank of product P (not shown).

The lower portion 2*b* ends at the bottom with a connecting portion 2*c* with which a ring nut 16 is coupled, preferably with a bayonet coupling. The ring nut 16 comprises an edge 16*a* projecting inwards, in which a sealing ring 15 is arranged. Thereby, a recess 19 having an axial extension H is created between the shoulder 17 of the hollow body 2 and the edge 16*a* of the ring nut 16.

The ring nut 16 is removable and may be replaced with a so-called "false bottle", for example, which can be used when maintaining the device. In this case, a sanitizing fluid is indeed circulated inside the hollow body 2, thus obtaining a perfect cleaning of all the inner parts of the device which came in contact with product P.

The shutter member 3 is axially movable and comprises a hollow cylinder 18 with a median portion 18' projecting outwards. The median portion 18' preferably corresponds to a portion of the hollow cylinder 18 with greater wall thickness, so that the inner cavity of the hollow cylinder 18 is uniformly cylindrical.

Figure 2:
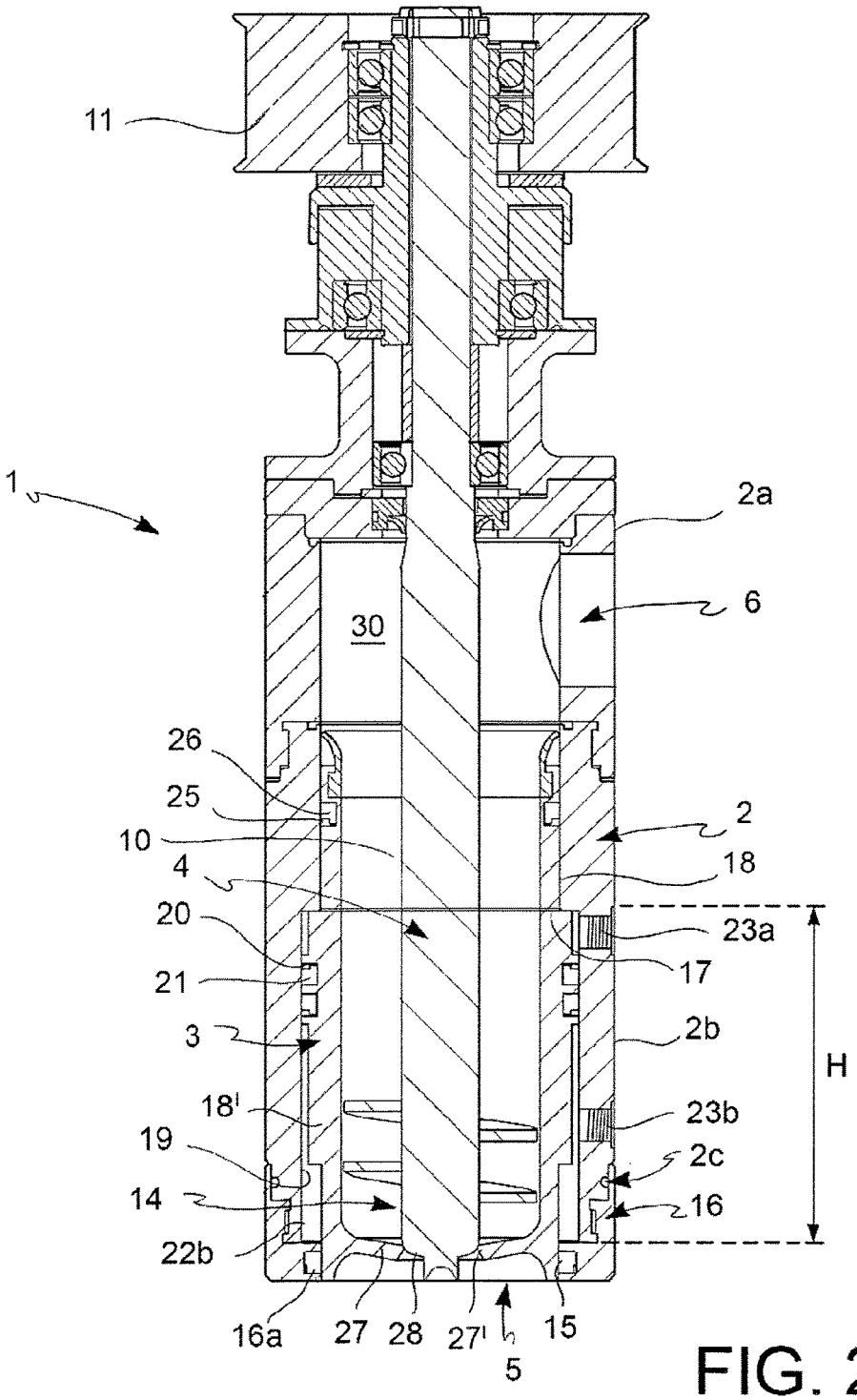
FIG. 2 depicts a side section view of the valve of the invention, in a first operating condition.
Figure 3:
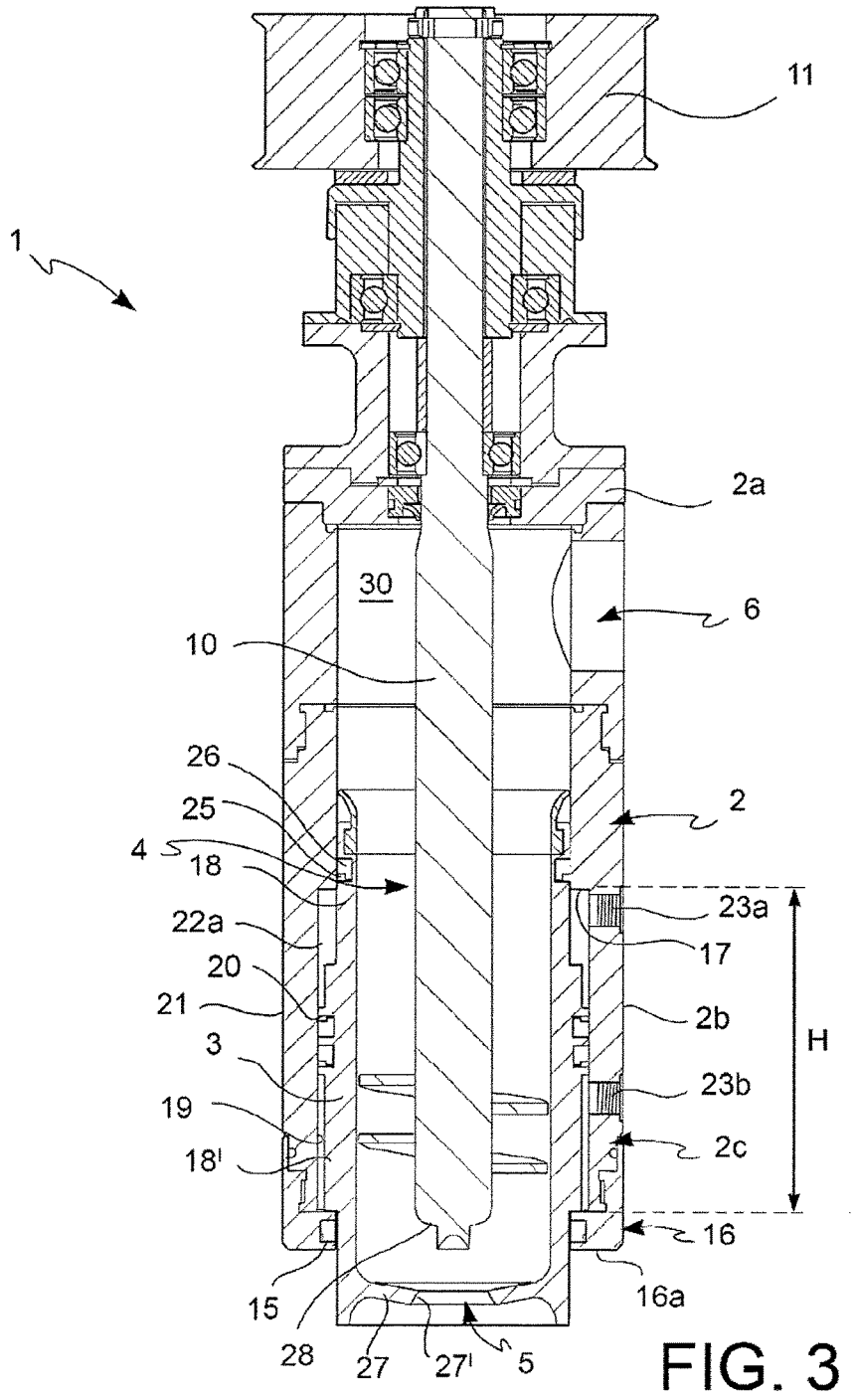
FIG. 3 depicts the view in FIG. 2, in a second operating condition.

The axial extension of the median portion 18' of the shutter member 3 is smaller than the axial extension H of recess 19 and the outer diameter thereof is substantially equal to, or slightly smaller than, the inner diameter of recess 19. The median portion 18' comprises a seat 20 for a gasket 21, for example two O-rings arranged in specific notches adjacent to each other, so as to sealingly isolate an upper annular chamber 22*a* (shown in FIG. 3) from a lower annular chamber 22*b* (shown in FIG. 2), said chambers 22*a*, 22*b* being formed alternatively according to whether the shutter member 3 is in the raised position or in the lowered position, respectively. The shoulder 17 of the hollow body 2 and the edge 16*a* of the ring nut 16 act as abutting elements for the median portion 18' of shutter 3, thus limiting the sliding inside recess 19.

The hollow body 2 comprises an upper opening 23*a* and a lower opening 23*b* which open at recess 19, where the upper opening 23*a* is arranged at the height of the upper annular chamber 22*a* and the lower opening 23*b* is arranged at the height of the lower annular chamber 22*b*, so that when shutter 3 is in the raised position (FIG. 2), the upper opening 23*a* is obstructed by the surface of the hollow cylinder 18, while the lower opening 23*b* opens into the lower annular chamber 22*b*, whereas when shutter 3 is in the lowered position (FIG. 3), the lower opening 23*b* is obstructed by the surface of the hollow cylinder 18, while the upper opening 23*a* opens into the upper annular chamber 22*a*.

Both the upper opening 23*a* and the lower opening 23*b* are connected to an actuating fluid source, preferably compressed air, by means of suitable pipes 24, 24'. Thereby, the actuating member 3 may be moved between the raised position and the lowered position, thus introducing the actuating fluid alternatively into the lower annular chamber 22*b* or the upper annular chamber 22*a*.

The hollow cylinder 18 comprises, close to the upper end thereof, a further seat 25 for a sealing ring 26.

The hollow cylinder 18 ends inferiorly with a bottom 27 in which said dispensing opening 5 opens, edged by a coupling edge 27'.

The dispensing member 4 comprises a shaft 10 connected at the top to a pulley 11. Pulley 11 is connected to a motor 13 by means of a transmission system 12, such as a toothed belt, a chain or the like. As mentioned above, motor 13 may be a motor which operates all the filling devices 1 arranged on a filling machine or may be a dedicated motor thereof, exclusively dedicated to operating the filling device 1 to which it is connected. In the first case, the dispensing member 4 of all devices 1 is equipped with a brake/friction system for engaging or disengaging shaft 10 according to the predefined law of motion. The brake/friction system may be actuated by means of a suitable electric actuator or by means of a cam. The brake/friction system used is of the conventional type, for example it may be of the KEB COMBINORM-C type.

Shaft 10 comprises a screw portion 14 at the bottom, in particular a single-principle screw. The outer diameter of the screw portion 14 substantially corresponds to the inner diameter of the hollow cylinder 18 so that the screw "scrapes" the inner walls of the hollow cylinder 18.

Therefore, a cavity 30 is formed above the screw portion 14, which is always filled with product P, even when the valve is closed.

The lower end of shaft 10 ends with a push rod 28 having a chamfered profile so as to cooperate with the coupling edge 27' of the dispensing opening 5 to close the valve. When the shutter member 3 is in the raised position, the coupling edge 27' interferes with the push rod 28, thus closing the dispensing opening 5 of the filling device 1, while when the shutter member 3 is in the lowered position (FIG. 3), the dispensing opening 5 is open and product P may be dispensed into container C.

The filling device 1 comprises a command and control unit UCC operatively connected to the loading cell 9 and to the mechanisms for actuating the dispensing member 4 (dedicated motor 13 or brake/friction system) and for introducing the actuating fluid along the conduits 24, 24' (control unit F diagrammatically depicted in FIG. 1). The unit UCC may perform at least the following functions:

a) reading the tare of container C on the loading cell 9;
b) actuating the dispensing member 4 and introducing the actuating fluid into the upper annular chamber 22*a* so as to move the shutter member downwards and open the dispensing opening 5 according to a predefined law of motion;
c) detecting the weight of the container during the filling;
d) upon reaching a predefined weight, stopping the dispensing member 4 and actuating the introduction of actuating fluid into the lower annular chamber 22*b* so as to move the shutter member upwards and close the dispensing opening 5 according to said predefined law of motion.

The law of motion for actuating the dispensing member 4 and opening/closing the dispensing opening 5 depends on the type of product, i.e. the density thereof, the presence of larger or smaller heterogeneous pieces, etc. In certain cases, the dispensing member 4 may be actuated or stopped simultaneously as the dispensing opening 5 is opened or closed, respectively. In other cases, the actuation or stopping of the dispensing member 4 may be brought forward or delayed with respect to the opening/closing of the dispensing opening 5. In certain cases, in particular if the density of product P is quite high, the closing of the dispensing opening 5 and/or the stopping of the dispensing member 4 may be brought forward with respect to the achievement of the predefined weight of container C, so as to take into account the electro-mechanical actuation delays and/or the time needed by the product P dispensed by the dispensing opening 5 to reach container C.

The determination of the correct law of motion will be performed by conveniently adjusting the filling device case by case.

The dispensing member 4 provided with screw 14 has the dual function of imparting the due dispensing pressure to product P and of providing for the continuous mixing thereof in order to make the mass of product being dispensed as homogeneous as possible.

The filling device according to the invention generates a net weight filling system with the aid of volumetric systems which allow to process heterogeneous products, with the guarantee of introducing packages onto the market with the same product quantities as the weight declared on the label. This generates significant savings, thus avoiding the overfilling of the container which is instead necessary with traditional volumetric systems.

It is apparent that only certain particular embodiments of the present invention have been described, to which those skilled in the art can make all those modifications required for the adaptation thereof to particular applications without however departing from the scope of protection of the present invention.

What we claim is:

1. A filling device (1) for filling machines, the filling device comprising: a hollow body (2) wherein a shutter member (3) is movably fitted, acting in cooperation with a dispensing member (4), coaxial to said shutter member (3), for closing or opening a dispensing opening (5) for a product (P) to be dispensed in a container (C), wherein said dispensing member (4) comprises a rotatable shaft (10) comprising a screw portion (14) adapted to impart a dispensing pressure and a mixing to the product (P), wherein the hollow body (2) comprises an upper portion (2*a*) and a lower portion (2*b*), wherein the lower portion (2*b*) of the hollow body (2) ends inferiorly with a connecting portion (2*c*) to which a ring nut (16) is removably coupled, wherein the ring nut (16) comprises an edge (16*a*) projecting inwards, so as to create a recess (19) having an axial extension (H) comprised between the shoulder (17) of the hollow body (2) and the edge (16*a*) of the ring nut (16), wherein the shutter member (3) is axially movable and comprises a hollow cylinder (18) with a median portion (18') projecting outwards, wherein the axial extension of the median portion (18') of the shutter member (3) is substantially equal to or slightly smaller than the axial extension (H) of the recess (19) and its outer diameter is substantially equal to an inner diameter of the recess (19), so as to sealingly isolate an upper annular chamber (22*a*) from a lower annular chamber (22*b*), said chambers (22*a*, 22*b*) forming alternately when the shutter member (3) is in a raised position or in a lowered position, respectively, and wherein the hollow body (2) comprises an upper opening (23*a*) and a lower opening (23*b*) which open at the recess (19), wherein the upper opening (23*a*) is placed at a height of the upper annular chamber (22*a*) and the lower opening (23*b*) is placed at a height of the lower annular chamber (22*b*), so that when the shutter (3) is in the raised position, the upper opening (23*a*) is obstructed by the surface of the hollow cylinder (18), while the lower opening (23*b*) opens into the lower annular chamber (22*b*), whereas when the shutter (3) is in the lowered position, the lower opening (23*b*) is obstructed by the surface of the hollow cylinder (18), while the upper opening (23*a*) opens into the upper annular chamber (22*a*); and wherein both the upper opening (23*a*) and the lower opening (23*b*) are connected to an actuating fluid source, wherein said dispensing member (4) comprises a rotatable shaft (10) comprising a screw portion (14) configured to impart a dispensing pressure and a mixing to the product (P).

2. The filling device (1) according to claim 1, wherein the filling device (1) is comprised in a linear or rotary filling machine, wherein the filling device (1) is operable in sequence, and wherein the filling device (1) is arranged above a container (C) supported by a plate (8), the plate (8) being operatively arranged on a loading cell (9) for weighing the empty and full container (C).

3. The filling device (1) according to claim 1, wherein the hollow body (2) comprises an upper portion (2*a*) and a lower portion (2*b*), the upper portion (2*a*) having a wall thickness greater than the lower portion (2*b*), so as to form a shoulder (17) facing downwards at a junction point between said upper portion (2*a*) and said lower portion (2*b*); wherein an inlet opening (6) for the product (P) is open in the upper portion (2*a*).

4. The filling device (1) according to claim 3, wherein the lower portion (2*b*) of the hollow body (2) ends inferiorly with a connecting portion (2*c*) to which a ring nut (16) is removably coupled, wherein the ring nut (16) comprises an edge (16*a*) projecting inwards, so as to create a recess (19) having an axial extension (H) comprised between the shoulder (17) of the hollow body (2) and the edge (16*a*) of the ring nut (16).

5. The filling device (1) according to claim 1, wherein the shutter member (3) is axially movable and comprises a hollow cylinder (18) with a median portion (18') project ting outwards.

6. The filling device (1) according to claim 5, wherein an axial extension of the median portion (18') of the shutter member (3) is smaller than an axial extension (H) of the recess (19) and its outer diameter is substantially equal to or slightly smaller than the inner diameter of the recess (19), so as to sealingly isolate an upper annular chamber (22*a*) from a lower annular chamber (22*b*), said chambers (22*a*, 22*b*) forming alternately depending on whether the shutter member (3) is in the raised position or in the lowered position, respectively.

7. The filling device (1) according to claim 6, wherein the hollow body (2) comprise an upper opening (23*a*) and a lower opening (23*b*) which open at the recess (19), wherein the upper opening (23*a*) is placed at the height of the upper annular chamber (22*a*) and the lower opening (23*b*) is placed at the height if the lower annular chamber (22*b*), so that when the shutter (3) is in the raised position, the upper opening (23*a*) is obstructed by the surface of the hollow cylinder (18), while the lower opening (23*b*) opens into the lower annular chamber (22*b*), whereas when the shutter (3) is in the lowered position, the lower opening (23*b*) is obstructed by the surface of the hollow cylinder (18), while the upper opening (23*a*) opens into the upper annular chamber (22*a*); and wherein both the upper opening (23*a*) and the lower opening (23*b*) are connected to an actuating fluid source.

8. The filling device (1) according to claim 5, wherein the hollow cylinder (18) ends inferiorly with a bottom (27) wherein said dispensing opening (5) edged by a coupling edge (27') opens.

9. The filling device (1) according to claim 1, wherein the shaft (10) of the dispensing member (4) is connected superiorly to a pulley (11) connected to a motor (13) through a transmission system (12).

10. The filling device (1) according to claim 5, wherein the outer diameter of the screw portion (14) is substantially corresponding to the inner diameter of the hollow cylinder (18) so that the screw scrapes the inner wall of the hollow cylinder (18).

11. The filling device (1) according to claim 8, wherein the lower end of the shaft (10) ends with a push rod (28) having a chamfered profile so as to cooperate with the coupling edge (27') of the dispensing opening (5) for closing the dispensing opening (5).

12. The filling device (1) according to claim 7, comprising a command and a control unit (UCC) operatively connected to a loading cell (9) and to mechanisms for actuating the dispensing member (4) and introducing the actuating fluid alternatively in the upper annular chamber (22*a*) or in the lower annular chamber (22*b*) wherein the command and control unit (UCC) is configured to carry out at least the following functions:

a) reading the tare of the container (C) on the loading cell (9);

b) actuating the dispensing member (4) and the introduction of the actuating fluid in the upper annular chamber (22*a*) so as to move the shutter member (3) downwards and open the dispensing opening (5) according to predefined motion;

c) detecting the weight of the container (C) during the filling:

d) upon reaching a predefined weight, stopping the dispensing member (4) and actuating the introduction of the actuating fluid in the lower annular chamber (22*b*) so as to move the shutter member (3) upwards and close the dispensing opening (5) according to said predefined law of the motion.

13. The filling device (1) according to claim 12, wherein the predefined motion for actuating the dispensing member (4) and the opening/closing of the dispensing opening (5) is configured to provide the following functions:

i) the dispensing member (4) is actuated or stopped at the same time as the opening or closing of the dispensing opening (5), respectively;

ii) the actuation or stopping of the dispensing member (4) is moved up or delayed with respect to the opening/closing of the dispensing opening (5);

iii) the closing of the dispensing opening (5) and/or the stopping of the dispensing member (4) are moved up with respect to the achievement of the predefined weight of the container (C), so as to take into account the electro-mechanical actuation delays and/or the time needed by the product (P) dispensed by the dispensing opening (5) to reach the container (C).

* * * * *